US012180825B2

(12) United States Patent
Lastra Melo et al.

(10) Patent No.: US 12,180,825 B2
(45) Date of Patent: Dec. 31, 2024

(54) ADVANCED DIAGNOSTICS AND CONTROL SYSTEM FOR ARTIFICIAL LIFT SYSTEMS

(71) Applicants: SAUDI ARABIAN OIL COMPANY, Dhahran (SA); Shanks Tech Ltd, Aberdeen (GB)

(72) Inventors: Rafael Adolfo Lastra Melo, Dhahran (SA); Dave Shanks, Aberdeen (GB); Jinjiang Xiao, Dhahran (SA); Christopher Wrighton, Aberdeenshire (GB)

(73) Assignees: SAUDI ARABIAN OIL COMPANY, Dhahran (SA); SHANKS TECH LTD, Aberdeen (GB)

( * ) Notice: Subject to any disclaimer, the term of this patent is extended or adjusted under 35 U.S.C. 154(b) by 8 days.

(21) Appl. No.: 17/700,468

(22) Filed: Mar. 21, 2022

(65) Prior Publication Data

US 2023/0296015 A1 Sep. 21, 2023

(51) Int. Cl.
*E21B 47/008* (2012.01)

(52) U.S. Cl.
CPC ..... *E21B 47/008* (2020.05); *E21B 2200/20* (2020.05); *E21B 2200/22* (2020.05)

(58) Field of Classification Search
CPC ..... E21B 43/128; E21B 47/008; F04D 13/10; F04D 15/0027; F04B 47/06; F04B 47/00
See application file for complete search history.

(56) References Cited

U.S. PATENT DOCUMENTS

| | | | | |
|---|---|---|---|---|
| 7,906,973 | B1 * | 3/2011 | Orr | H04L 43/50 324/543 |
| 9,720,424 | B2 | 8/2017 | Ige et al. | |
| 11,326,423 | B2 * | 5/2022 | Alanazi | E21B 41/0092 |
| 2004/0046570 | A1 * | 3/2004 | Teich | G01R 31/58 324/541 |

(Continued)

FOREIGN PATENT DOCUMENTS

| | | | |
|---|---|---|---|
| WO | 2016205101 | A1 | 12/2016 |
| WO | 20206403 | A1 | 1/2020 |

*Primary Examiner* — Kipp C Wallace
(74) *Attorney, Agent, or Firm* — Osha Bergman Watanabe & Burton LLP

(57) ABSTRACT

A diagnostics and control system (DCS) for an artificial lift system (ALS) in a well, comprising: a sensor network comprising a plurality of sensors for monitoring and obtaining measurements at a power source of the ALS and at a downhole pump of the ALS; a conditioning subsystem configured to measure ALS system performance data; a processing subsystem configured to receive communications from the conditioning subsystem and comprising a processor configured to process sensor data obtained by the sensor network; and a permanent local wellsite monitor that is controlled by the processing subsystem and is powered using a production controller of the ALS, wherein the permanent local wellsite monitor comprises a central surveillance center for transmitting commands and coordinating testing of the ALS among the sensor network, the conditioning subsystem, and the processing subsystem; wherein a condition of the ALS is evaluated by the permanent local wellsite monitor using the processed sensor data, (Continued)

testing results and system performance data to monitor a health of the ALS.

17 Claims, 5 Drawing Sheets

(56) References Cited

U.S. PATENT DOCUMENTS

| | | | | |
|---|---|---|---|---|
| 2008/0187444 | A1* | 8/2008 | Molotkov | G05B 13/024 417/44.1 |
| 2010/0150737 | A1* | 6/2010 | Anderson | G01F 23/22 702/6 |
| 2011/0304340 | A1* | 12/2011 | Hall | G01R 31/11 324/533 |
| 2012/0027630 | A1* | 2/2012 | Forsberg | E21B 47/008 73/24.06 |
| 2013/0175030 | A1* | 7/2013 | Ige | G05B 15/02 700/282 |
| 2015/0083399 | A1* | 3/2015 | Fripp | G01R 31/08 166/250.01 |
| 2016/0281479 | A1 | 9/2016 | Rendusara et al. | |
| 2016/0290077 | A1* | 10/2016 | Aske | E21B 47/008 |
| 2017/0101863 | A1 | 4/2017 | Coste et al. | |
| 2017/0363088 | A1* | 12/2017 | Nguyen | E21B 47/008 |
| 2019/0052190 | A1* | 2/2019 | Sodo | G01R 31/42 |
| 2019/0317488 | A1* | 10/2019 | Al-Maghlouth | G05B 23/024 |
| 2020/0325766 | A1* | 10/2020 | Gupta | E21B 47/008 |
| 2021/0062627 | A1* | 3/2021 | Arukhe | E21B 41/0035 |
| 2023/0019875 | A1* | 1/2023 | Brown | E21B 49/087 |

* cited by examiner

ADVANCED DIAGNOSTICS AND CONTROL SYSTEM FOR ARTIFICIAL LIFT SYSTEMS

BACKGROUND OF INVENTION

In the field of oil and gas, artificial lift systems are used in well production. Artificial lift is a process used on oil wells to increase pressure within the reservoir and encourage oil to the surface. Artificial lift systems include but are not limited to electrical submersible pumps, progressing cavity pumps, beam pumping, and gas lift systems. Unexpected artificial lift system failures directly affect oil production performance, and in many cases, the logistics of replacing the equipment is a costly and complex process. When the above-described diagnostics and control system method is adopted, early problems are detected that reduce well downtime and associated production losses. Artificial lift system failures can be related to electrical failures, mechanical failures, and operational failures. Problem and failure examples include motor overheating, hydraulic loading, voltage spikes, cable insulation degradation, and cable failures.

Therefore, the development and application of advanced diagnostic technologies is key in minimizing operational cost impact and maximizing the return on investment.

SUMMARY OF INVENTION

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure presents, in one or more embodiments, a system and a method for well production control and diagnostics of artificial lift equipment.

In one aspect, one or more embodiments relate to a diagnostics and control system (DCS) for an artificial lift system (ALS) in a well, comprising: a sensor network comprising a plurality of sensors for monitoring and obtaining measurements at a power source of the ALS and at a downhole pump of the ALS; a conditioning subsystem configured to measure ALS system performance data; a processing subsystem configured to receive communications from the conditioning subsystem and comprising a processor configured to process sensor data obtained by the sensor network; and a permanent local wellsite monitor that is controlled by the processing subsystem and is powered using a production controller of the ALS, wherein the permanent local wellsite monitor comprises a central surveillance center for transmitting commands and coordinating testing of the ALS among the sensor network, the conditioning subsystem, and the processing subsystem; wherein a condition of the ALS is evaluated by the permanent local wellsite monitor using the processed sensor data, testing results and system performance data to monitor a health of the ALS.

In one aspect, one or more embodiments relate to a method for monitoring a health of an artificial lift system (ALS) comprising: installing a diagnostic and control system (DCS) in a well operated with the ALS, the DCS comprising a sensor network for obtaining sensor measurements at at least a downhole pump of the ALS, a processing subsystem for processing sensor data from the sensor measurements, and a conditioning subsystem configured to measure ALS system performance data; coordinating and performing periodic automated testing of the ALS by the DCS; capturing current and voltage waveforms, harmonic content, and frequency content of components of the ALS; and evaluating a condition of the ALS using the sensor measurements and system performance data to monitor a health of the ALS, wherein the current and voltage waveforms, harmonic content, and frequency content of components of the ALS are used to obtain a complete pattern of ALS system performance.

Other aspects and advantages of the invention will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
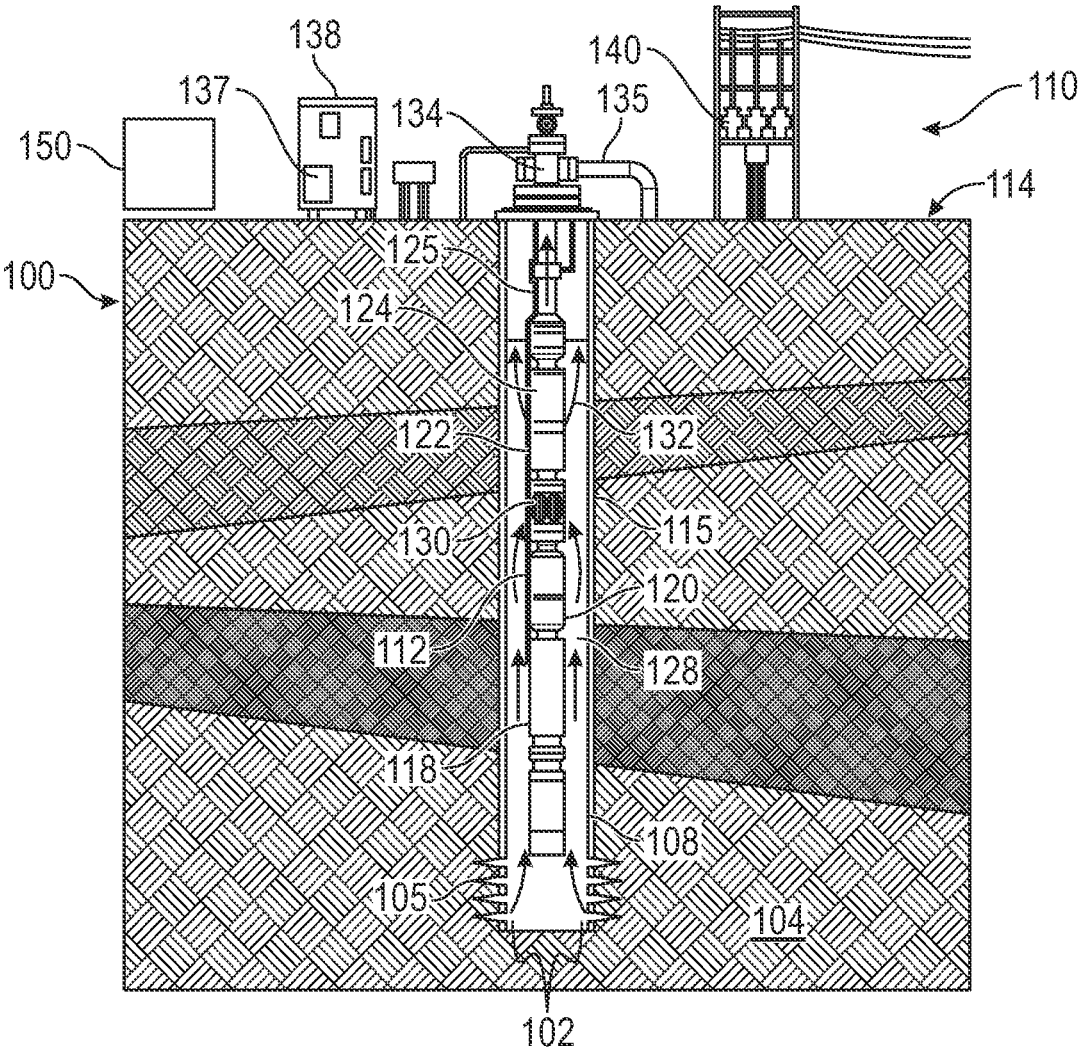
FIG. 1 shows an exemplary well with an Electrical Submersible Pump (ESP) completion design in accordance with one or more embodiments.

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

FIG. 1 shows an exemplary Electrical Submersible Pump (ESP) system (100). The ESP system (100) is one example of an artificial lift system that is used to help produce fluids (102) from a formation (104). Perforations (105) in the well's (115) casing string (108) provide a conduit for the produced fluids (102) to enter the well (115) from the formation (104). As ESP system (100) is an example of the artificial lift system, ESP system and artificial lift system may be used interchangeably within this disclosure. The ESP system (100) includes surface equipment (110) and an ESP string (112). The ESP string (112) is deployed in a well (115) and the surface equipment (110) is located on the surface (114). The surface (114) is any location outside of the well (115), such as the Earth's surface.

The ESP string (112) may include a motor (118), motor protectors (120), a gas separator (122), a multi-stage centrifugal pump (124) (herein called a "pump" (124)), and an electrical cable (125). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the pump (124) requires to lift an estimated volume of produced fluids (102) from the bottom of the well (115) to the surface (114). The motor (118) is cooled by the produced fluids (102) passing over the motor housing. The motor (118) is powered by the electrical cable (125). The electrical cable (125) may also provide power to downhole pressure sensors or onboard electronics that may be used for communication. The electrical cable (125) is an electrically conductive cable that is capable of transferring information. The electrical cable (125) transfers energy from the surface equipment (110) to the motor (118). The electrical cable (125) may be a three-phase electric cable that is specially designed for downhole environments. The electrical cable (125) may be clamped to the ESP string (112) in order to limit electrical cable (125) movement in the well (115). In further embodiments, the ESP string (112) may have a hydraulic line that is a conduit for hydraulic fluid. The hydraulic line may act as a sensor to measure downhole parameters such as discharge pressure from the outlet of the pump (124).

Motor protectors (120) are located above (i.e., closer to the surface (114)) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from produced fluids (102). The seals further equalize the pressure in the annulus (128) with the pressure in the motor (118). The annulus (128) is the space in the well (115) between the casing string (108) and the ESP string (112). The pump intake (130) is the section of the ESP string (112) where the produced fluids (102) enter the ESP string (112) from the annulus (128).

The pump intake (130) is located above the motor protectors (120) and below the pump (124). The depth of the pump intake (130) is designed based off of the formation (104) pressure, estimated height of produced fluids (102) in the annulus (128), and optimization of pump (124) performance. If the produced fluids (102) have associated gas, then a gas separator (122) may be installed in the ESP string (112) above the pump intake (130) but below the pump (124). The gas separator (122) removes the gas from the produced fluids (102) and injects the gas (depicted as separated gas (132) in FIG. 1) into the annulus (128). If the volume of gas exceeds a designated limit, a gas handling device may be installed below the gas separator (122) and above the pump intake (130).

The pump (124) is located above the gas separator (122) and lifts the produced fluids (102) to the surface (114). The pump (124) has a plurality of stages that are stacked upon one another. Each stage contains a rotating impeller and stationary diffuser. As the produced fluids (102) enter each stage, the produced fluids (102) pass through the rotating impeller to be centrifuged radially outward gaining energy in the form of velocity. The produced fluids (102) enter the diffuser, and the velocity is converted into pressure. As the produced fluids (102) pass through each stage, the pressure continually increases until the produced fluids (102) obtain the designated discharge pressure and has sufficient energy to flow to the surface (114).

In other embodiments, sensors may be installed in various locations along the ESP string (112) to gather downhole data such as pump intake volumes, discharge pressures, shaft speeds and positions, and temperatures. The number of stages is determined prior to installation based of the estimated required discharge pressure. Over time, the formation (104) pressure may decrease and the height of the produced fluids (102) in the annulus (128) may decrease. In these cases, the ESP string (112) may be removed and resized. Once the produced fluids (102) reach the surface (114), the produced fluids (102) flow through the wellhead (134) into production equipment (135). The production equipment (135) may be any equipment that can gather or transport the produced fluids (102) such as a pipeline or a tank.

The remainder of the ESP system (100) includes various surface equipment (110) such as electric drives (137), production controller (138), the control module, and an electric power supply (140). The electric power supply (140) provides energy to the motor (118) through the electrical cable (125). The electric power supply (140) may be a commercial power distribution system or a portable power source such as a generator. The production controller (138) is made up of an assortment of intelligent unit-programmable controllers and drives which maintain the proper flow of electricity to the motor (118) such as fixed-frequency switchboards, soft-start controllers, and variable speed controllers. The production controller (138) may be a variable speed drive (VSD), well choke, inflow control valve, and/or sliding sleeves. The production controller (138) is configured to perform automatic well operation adjustments. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

In some embodiments, the ESP system (100) includes a Diagnostics and Control System (DCS) (150). For example, the DCS (150) may include hardware and/or software with the functionality for performing advanced diagnostics and control of an artificial lift system, such as the ESP system (100). The DCS (150) may be connected to the power system of the ESP system (100) or other artificial lift systems including high voltage electrical components to separate communications and power streams. In some embodiments, the DCS (150) may include a computing device such as the computer system described below with regard to FIG. 5 and the accompanying description.

Figure 2:
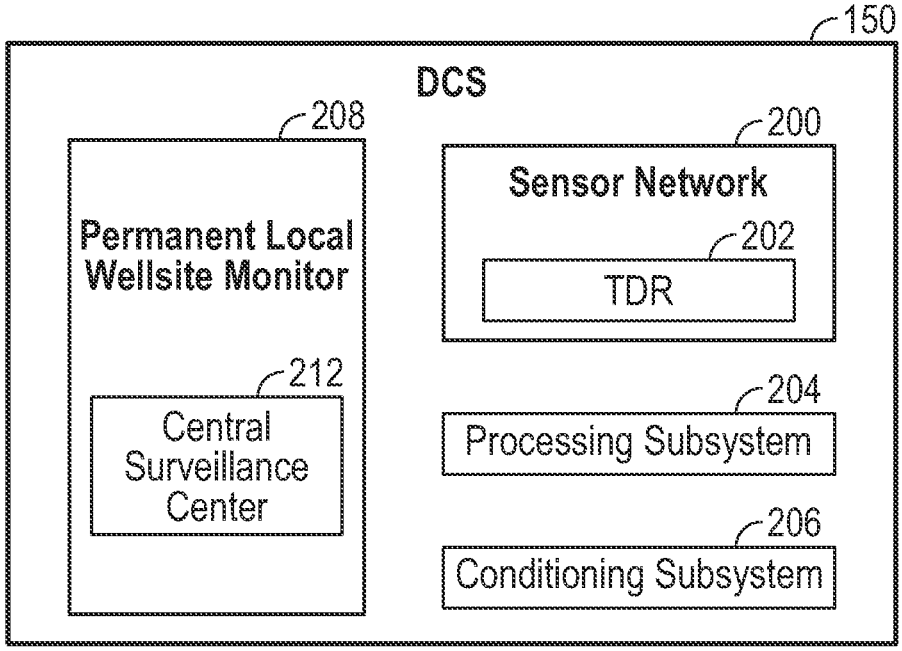
FIG. 2 shows a Diagnostics and Control System (DCS) in accordance with one or more embodiments.

FIG. 2 shows a DCS (150) in accordance with one or more embodiments. Within the DCS (150), there includes a sensor network (200), a processing subsystem (204), a conditioning subsystem (206), and a permanent local wellsite monitor (208). Each of these components of the DCS (150) are explained in further detail below.

The sensor network (200) may contain a variety of sensors and transducers including but not limited to infrared, light, ultrasonic, acoustic, chemical, accelerometers, humidity, touch, voltage, current, vibration, pressure, temperature, both electronic or optical. Optical sensors may include camera sensors. The sensor network (200) may contain flow and fluid mixture monitoring including but not limited to water cut, density, and venturi. The sensor network (200) may be discrete or distributed in the well (115) and reservoir. In one or more embodiments, the sensor network (200) of the DCS (150) includes several sensor subsystems that may be disposed at the surface and/or downhole. The sensor subsystems may include but are not limited to a surface sensor subsystem and a downhole sensor subsystem. The sensor network (200) may include sensors used for monitoring and obtaining measurements at a power source of the artificial lift system (e.g., 100), at the surface power supply (300), and at a downhole pump (124). There may be further sensors integral with the permanent local wellsite monitor (208) of production pipelines and security systems. In one or more embodiments, the sensor network (200) is configured to acquire high frequency data on a well and equipment performance of the ESP system (100). High frequency data may include the capture of waveforms and fast sampling. The sensor network also coordinates customized tests and data collection via two-way communications among the DCS (150) components. The sensor network (200) may perform electrical performance testing and data collection. In one or more embodiments, the sensor network (200) includes several subsystems which provide an interface for sensing, communications, and power management for the DCS (150). The sensor subsystems of the sensor network (200) are used to harvest energy from the ALS or the environment such as solar, wind, or electromagnetic induction and to provide power to the DCS (150) from ALS components. Harvesting energy is achieved by using current transformers and/or voltage taps on to the artificial lift system power supply, and then using a rectifier and a small local battery to create and sustain a local DC power supply and a wide range DC-DC converter to generate power for the electronics systems. This process can be augmented by solar or wind power, again charging the main DC battery. In another embodiment, power is extracted from the motor power conductors using a capacitive coupled retrofit clamp on power couplings. In other embodiments, a form of inductive coupling may be obtained through the transformers. In one or more embodiments, the DCS (150) may use a local direct current (DC) re-chargeable battery to store and sustain DC power. The DCS (150) components may be connected to the power system of the artificial lift system (e.g., 100) including high voltage electrical components to separate communications and power streams.

In one or more embodiments, the sensor network (200) includes a high-speed pulse reflection technology (i.e., time-domain reflectometer (TDR)) (202). The TDR (202) may work with the sensor network (200) rather than be integrated into the sensor network (200) as shown in FIG. 2 to monitor the condition of the insulation and conductors of the power cable (125). TDR (202) is used for diagnosing cable faults in artificial lift systems (e.g., 100) by cable condition measurement. For example, the TDR (202) records a cable condition at the time the multi-stage centrifugal pump (124) is stopped by firing very fast TDR (202) pulses down each conductor of the 3-phase power system and recording the response from each conductor separately. For example, the TDR is configured to fire pulses on one phase only and look for responses on the non-live phases. Such a response is interpreted by the TDR as both system component failure and also developing patterns which associate this with changes in stray capacitance in the surface transformer and downhole motor.

The TDR (202) system is able to record the trace pattern over a period of at least 24 hours and this recording is used as a reference to compare with live traces in the future. In other words, TDR (202) obtains reflections from any discontinuity in the cable and is accurate at detecting short or open circuit conductors in a damaged cable. The TDR is also configured to respond to more subtle damage to the cable sheath and the insulation in the cable. By measuring the time it takes for the rapid-fired pulses to hit the discontinuity and return, and given some knowledge of the cable properties, it is possible to discern how far away the discontinuity is. The TDR process also creates a certain response from the healthy segments of the cable and uneven or nonlinear responses may be an indication of non-uniform inductance or capacitance. Changes in such a "good" response may also be sensitive indicators of the condition of the capacitance or indeed change in the inductance of the cable. This technique is particularly powerful as it creates an image of this linearity of the cable parameters over the length of the cable and enables creation of a real time spatial survey of the cable condition, which when compared over time is able to not only detect problems but also their location. TDR (202) capabilities may be embedded into the hardware or software of the conditioning subsystem (206). The circuitry may be located in the sensor network (200) and signal processing may be part of the permanent local wellsite monitor (208). Alternative configurations are possible without departing from the scope disclosed herein; for example, the TDR may be completely part of the sensor network.

In one or more embodiments, the record of trace patterns obtained by the TDR (202) is combined with the historical log of the system stored in the processing subsystem (204) that holds the same measurement over the life of the well (115). The TDR (202) is embedded with intelligence that allows variation of the live information to the reference trace to be automatically diagnosed as a cable condition. The intelligence may use one or more of the following: a detailed study of the power cable (125) electrical behavior in normal and fault conditions, review of stored information from historical field testing, associate particular trace patterns and process live reference patterns with faults found in post fault diagnosis using a software system, automatically using more than one pulse width/power combination to get near and far information from cable health, and firing high speed pulses on one phase only to look for responses on non-live phases and interpreting this as both system component failure to develop patterns that associate this with changes in stray capacitance in the surface transformer and motor (118). Pulses represent voltages of current signals that function from the zero value to a maximum value for a predetermined period of time then return to the zero value. Pulses may be periodic or occur over a period of time. Phases refer to the conductors in a multiphase electrical system. In one or more embodiments, the ESP system (100) works in a three-phase system with electrical signals in each phase and may be separated 120 degrees from each other.

In one or more embodiments, TDR (202) records the cable condition by firing a pulse down each phase of the power cable (125) while the motor is running and implements at least the following: capturing waveforms of the power voltage and current, establishing microsecond windows in each waveform cycles where the VSD noise is minimum and firing the pulse in the quietest time segment of the waveform, and using more than one operating window and comparing the data recovered from each window to remove only the common data in all windows and discount any data not common to remove the effects of spikes and high frequency noise from the production controller (138).

The DCS (150) also includes a processing subsystem (204). The processing subsystem (204) may be disposed at the surface in relative proximity to the sensor network (200) and/or may be connected to the sensor network (200) using cables, or alternatively, via a wireless link. The processing subsystem (204) contains processor/electronics for communications, control, storage, and security management. The processing subsystem (204) may also serve as the main user interface for the DCS (150) and is configured to perform a variety of functions. As a main user interface, the processing subsystem (204) may be fitted with a display and keyboard or alternatively with one or more wireless connections to the processing subsystem (204). The input/output device may be any suitable device such as a smart phone or a tablet.

Specifically, in one or more embodiments, the processing subsystem (204) is configured to consolidate the data gathered from the sensor network (200) and use embedded intelligence to summarize and calculate the net effect of the data input. In some embodiments, the processing subsystem (204) may detect damage on the power cable (125) based on the readings from the sensor network (200). In other embodiments, the processing subsystem (204) may detect abnormal switching patterns from the power controller output. The processing subsystem (204) may combine various sensor measurements to estimate efficiency in various parts of the ESP system (100) to indicate acceptability. Further, the location of losses in the ESP system (100) may be determined by the processing subsystem (204). The processing subsystem (204) may use high speed sensor capture for continuous signature monitoring to provide condition and longevity information on system components. As a prime interface point for users, the processing subsystem (204) is capable of presenting information in addition to sensor readings.

For example, the processing subsystem (204) is configured to perform test planning, data collection, data storage, real-time onsite analyses, messaging with critical alarms, system communications, and well equipment control. Further, the processing subsystem (204) may contain several serial communication ports for flexibility and both internal memory as well as removable memory for data logging. The processing subsystem (204) is configured to process signals and extract both alternating current (AC) and direct current (DC) content from large signals that may enable supply, harmonic, and ground balance determination.

Continuing with FIG. 2, the conditioning subsystem (206) of the DCS (150) may be digital or analog and contains communications and power streams that are separated and forwarded to the processing subsystem (204) via the DCS (150). The conditioning subsystem (206) may be used to measure artificial lift system (e.g., 100) system performance data and to forward communications through the DCS (150). System performance data may include but is not limited to pump intake pressure, pump discharge pressure, motor temperature, reservoir temperature, reservoir pressure, wellhead production pressure, wellhead annulus pressure, motor drive frequency, variable speed drive switching speed, motor voltage harmonics, motor current harmonics, VSD switching harmonics, surface temperature and wind speed, time, user intervention tracking, production choke position, production, pump efficiency, motor temperature, motor current, voltage, flow rate, fluid mixture, water oil and gas flow rates, and fluid level. The conditioning subsystem (206) is a series of circuits and mathematical functions that may allow the extraction of DC components and the higher frequency components of different sensor signals. The extraction of DC components may refer to sensing the DC power on the power cable (125) through the sensor network (200) to allow monitoring of the condition of the power supply. The DC components extracted may include DC voltage and current. The DC components may indicate cable damage. Cable damage indication may inform the user of preventative maintenance or warn that the well (116) may require corrective action in the following future. The conditioning subsystem (206) may allow subtraction and addition of signals such as phase to phase signals from individual phase measurements. Further, the conditioning subsystem (206) may filter core motor drive frequencies from a wider range signal containing harmonics and other signal components.

Further, the conditioning subsystem (206) may determine relative measurements including phase angle, harmonic content, supply stability, and separate core signals from switching noise. In one or more embodiments, the conditioning subsystem (206) is configured to capture additional raw data on artificial lift system performance. Such additional data may include, for example, electrical signals and data from other systems or transducers installed in or near the well (115). The conditioning subsystem (206) is located on surface in relative proximity to the processing subsystem (204). In one or more embodiments, the conditioning subsystem (206) captures complete patterns on system performance including voltage/current waveforms and harmonic content. The conditioning subsystem (206) transforms original signals into data that can be read by the processing subsystem (204). For example, the current readings are conditioned by the current transformers as a voltage signal proportional to the actual current value. The conditional may be simple signal scaling or complex transformations of the data measured such as current voltage.

The permanent local wellsite monitor (208) contains a central surveillance center (212). The permanent local wellsite monitor (208) is configured to evaluate the condition of the artificial lift system (e.g., 100) by continuously monitoring the health of the artificial lift system (e.g., 100). The permanent local wellsite monitor (208) may evaluate the condition of the artificial lift system (e.g., 100) by using processed sensor data and the system performance data. The central surveillance center (212) is a control center for artificial lift surveillance and is used to transmit alarms, diagnostic results, or raw data for further analysis. The central surveillance center (212) transmits commands to the DCS (150) which may contain data requests or actionable DCS (150) configurations. The processing subsystem (204) may be used to communicate with the central surveillance center (212). The central surveillance center (212) is connected directly to the end user to provide alarms and other critical information. The DCS (150) may be able to communicate with other DCS (150) installed in other wells in the proximate area as well as communicate with production equipment in other wells to perform automated field wide diagnostics and provide alarms and recommendations for an optimization process. Communicating with other DCS (150) can aid in sharing or requesting status and operational information.

Figure 3:
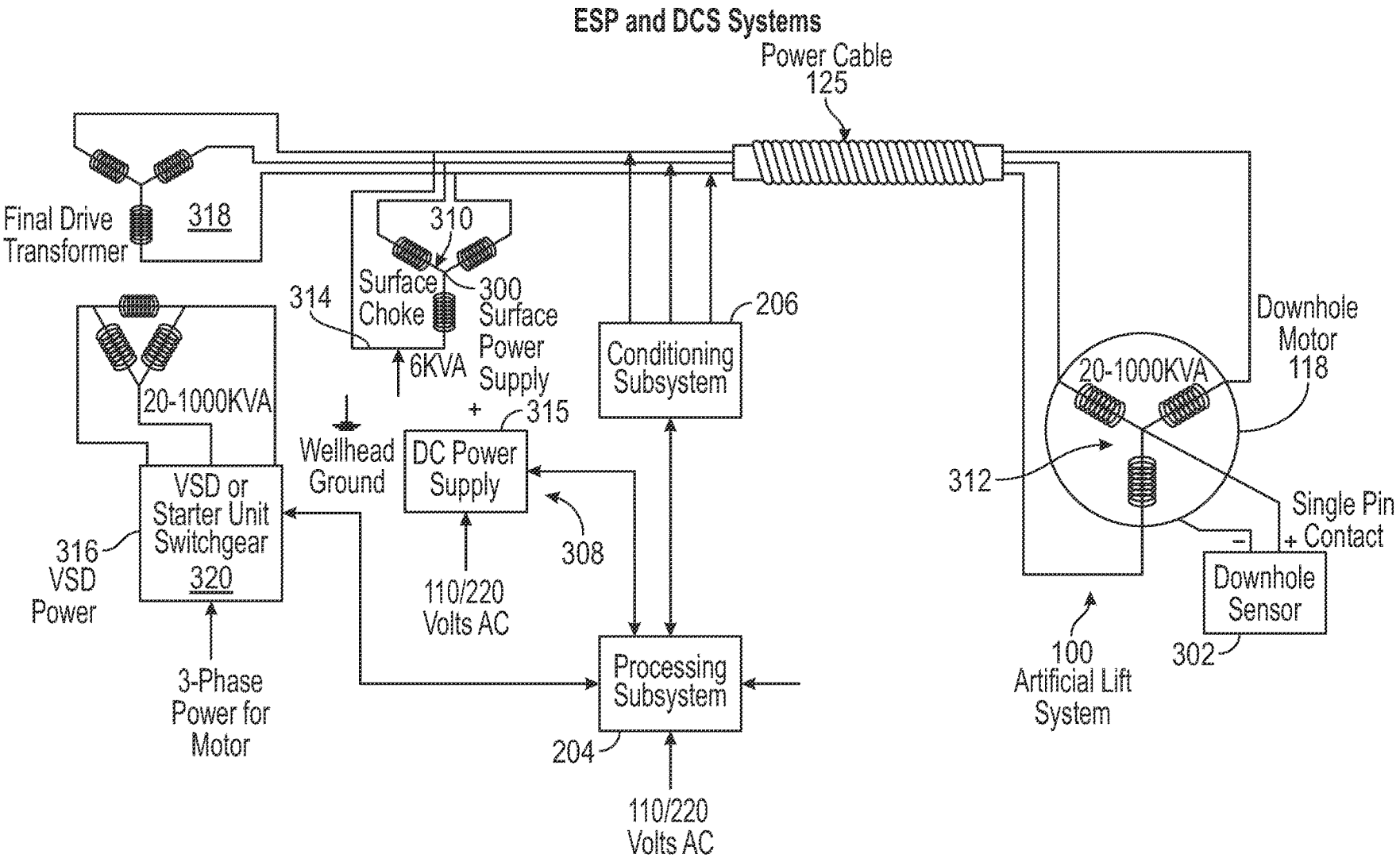
FIG. 3 shows a diagram illustrating further details of the DCS in accordance with one or more embodiments.

FIG. 3 shows a diagram illustrating further details of the DCS (150) in accordance with one or more embodiments. As described above, the sensor network (200) may include sensor subsystems having a surface power supply (300) for the downhole sensing and control array (308) system and a downhole sensor (302). The surface power supply (300) may be installed adjacent to the well production controllers (138). In one or more embodiments, the downhole sensor (302) is part of the downhole sensing and control array (308) system. The downhole sensor (302) is installed inside the well (115) and may be adjacent to or in some embodiments integral to the artificial lift system (e.g., ESP system (100)). There may be further sensors integral with the electric power supply (140) and production controller (138). The downhole sensor (302) may be connected to the motor (118). The motor (118) may be any electric machine that converts electrical energy into mechanical energy. In one or more embodiments, the sensor network (200) is connected to the power cable (125) of the artificial lift system (e.g., 100) and contains high voltage electrical components to separate communications and power streams. The communications may include the conditioning subsystem (206) and the processing subsystem (204).

In one or more embodiments, cable fault detection may be possible without integration of the conditioning subsystem (206) and other elements. One example refers to cable fault detections measured through a surface power supply (300) that is capable of determining the condition of the power cable (125). This process includes using one or more of the following:

1. Measurements of any current fed to the downhole sensing and control array (308) such as leakage current used to estimate cable insulation properties.
2. Measurements of any current drawn from a high frequency power source which is not attributable to losses in the motor (118) and surface transformer and utilizing the inductive nature of both the motor (118) and downhole 3-phase choke to block the surface transformer Y-point (318) and the downhole 3 phase-choke Y-point (312) wherever present from taking power from this source. Surface transformer Y-point (318) may include a surface choke (314). This current is then used to determine the condition of the cable insulation.
3. An alternating current (AC) power source as detailed previously where the capacitance of the system components that include the surface transformer, power cable (125), and motor (118) is modeled and removed from the reference conditions to enable a more accurate current leakage measurement.
4. Measurements of any current leakage by either preceding method (1 to 3) on each phase individually and using this to estimate both the absolute insulation condition of the power cable (125) but also the relative insulation condition of each phase wire in the power cable (125).
5. Measurements of ground referenced AC power on each phase of the 3-phase power system and using imbalance on the ground referenced voltage as a measure of imbalanced ground connection inherent in saltwater ingress faults on power cable (125).
6. Measurements of peak voltage to ground to estimate the increased stress on the power cable (125) insulation and estimate reduced working life span for the power cable (125) to allow preventative maintenance.
7. Insertion of a resistive link between the surface transformer Y-point (318) and ground to monitor the current to ground through this link. This information may be used to detect fault conditions where high levels of imbalance are present, where there is AC power to ground through Y-point, and also ground faults present where power flows to ground through the Y-point, with the direction being used to determine the likely source of this power. A person of ordinary skill in the art will appreciate that this process may be enhanced or alternatively done in the downhole sensing and control array (308). The downhole sensing and control array (308) measures the 3-phase power content at the downhole motor Y-point (318) to give indications of power cable (125) problems.
8. Insertion of an active link in the surface transformer Y-point (318), which injects AC or DC power supply (310) or both into surface transformer Y-point (318), and uses the current drawn from this power source to measure the insulation condition on the 3-phase power cable (125).
9. A power source in example 8 above that generates power at a specific frequency and uses selective filtering to detect the current drawn from the injected power source only in each phase individually. Current monitoring sensors may be mounted on each conductor of the 3-phase power system to obtain the measurements of cable insulation properties.

In another embodiment, identification of ESP pump patterns may be possible with the use of all above described techniques (1-9) and TDR (202) technology by generating a standard measurement system which is configured to develop a collection of measurements including basic power measurements, current and voltage waveforms and frequency content patterns of all of these which when compared with a historical log of this reading set can be used to work out whether any pump is working within acceptable norms or detect a problem. This standard measurement system involves the following:

a. Measurements of motor supply voltage, current, phase angle, and power quality by measuring sine quality, harmonic content, logging starts/stops, and any variations over time to compare with historical pump life data to determine healthy and un-healthy operating patterns. It is possible to include surface and downhole Y-point voltages, frequency content, and any current flowing at both Y-points. This may be included to add to the pattern data base and specifically will indicate any imbalance in the injected power and also any imbalance added by the cable. An example may include a flat cable.
b. Measurements of voltage and current waveforms on the motor power cable (125) and extract information specific to the quality and operation of the pump power source to develop patterns that may be matched with historical records to indicate potential power supply issues.

c. Operator input information on the exact VSD and pump/cable in the installation, including a model of the depth of the well (115), and fluid information compared operating logs of both steady state readings like voltage, current, flow, and producing pressure and wellhead pressure, compare the operating condition as measured with design pump curves and production model for that reservoir to establish if the ESP system (100) is operating in valid condition. Historical logs may be used of this design to compare to live records and operating performance records to match the live operating condition to predict run life and current operating efficiency.

In addition to elements of the conditioning subsystem (206) which may be developed further, there is potential for integration with other hardware around the ESP system (100). In one embodiment, the conditioning subsystem (206) may be combined with the downhole sensing and control array (308). The downhole sensing and control array (308) system may include discharge and intake pressures, temperatures, 3-axis vibrations, current, flow metering, water cut measurements, and future transducers. The downhole sensing and control array (308) has a measurement module mounted on the multi-stage centrifugal pump (124) and a surface DC power supply (310) and data logger, including a high voltage inductive coupling surface choke (314). The downhole sensing and control array (308) may include gauge signal detection made by combining a voltage or current sensor used to measure the motor voltage and current to detect data transmitted from the downhole sensor (302) to provide measurement of current leakage for each phase wire of the power cable (125) to then calculate the insulation resistance of each phase of the power cable (125) by integrating the power injected at surface with the measurements from the downhole sensing and control array (308). The downhole sensor used for gauge signal detection is suitable for the downhole motor power but also highly sensitive to much smaller signals and also incorporate selective frequency, and/or voltage/current filtering to extract the signals from the VSD power (316). The downhole sensing and control array may be feeding power into the ESP power system and is connected to an inductive surface transformer Y-point (318) and also to the downhole 3-phase choke Y-point (312). This allows the downhole sensing and control array (308) to add new measurements and capabilities to an extended conditioning subsystem (206). It is possible to further integrate waveform capture and frequency analysis of the waveforms to include vibration waveforms captured in the downhole sensing and control array (308). The vibration waveforms may be used to determine normal and abnormal vibration patterns coming from the ESP system (100).

Another example of integration in the conditioning subsystem (206) includes the use of surface power at different frequencies to generate a power test pattern and develop not only the DC resistance measurement of the cable resistance but also the reactive elements of the system, including capacitance and inductance. This measurement may be used to determine if the system displays normal parameters for the system type and also if there is any degradation or change in cable capacitance. This ground referenced measurement may include ground faults in the power cable (125) especially if the power cable (125) is imbalanced, as the cable-to-cable capacitance becomes ground referenced and this adds to the total capacitance to ground, on any individual conductor.

In another embodiment, gravity sensing or DC sensing vibration sensors maybe be integrated with the downhole sensor (302) to allow automatic measurements of the inclination of the ESP system (100) and may add to the pattern mapping in order for the inclination information to be part of the ESP life of pump analysis. There may be further integration with a system where the downhole sensing and control array (308) telemetry sends a series of electrical signal patterns which may include frequency sweeps that are then captured at surface after passing through the motor (118) and power cable (125). The recovered current and voltage waveforms from each individual phase may allow a comparative assessment of the condition of each phase of the power cable (125) based on attenuation and phase shift.

In one or more embodiments, the conditioning subsystem (206) may be combined with the VSD or Start unit Switchgear (320) to enable a monitoring system to monitor the input power and power quality and compare to the output power and power quality of the VSD or Starter unit Switchgear (320) to continuously monitor VSD efficiency and add input power quality to ESP system (100) pattern mapping. The monitoring system is further configured to allow the VSD or Starter unit Switchgear (320) to alter both the motor drive speed, VSD switching frequency, and variable output voltage for medium voltage drives to provide optimization of the ESP system (100). Elements of the pump operation that may be used as primary or secondary control targets are running the pump at a speed at which the VSD or Starter unit Switchgear (320) produces the least distorted waveforms, running the pump at a speed at which the VSD or Starter unit Switchgear (320) runs at its most efficient, or running the pump at a speed to provide maximum overall power into fluid power efficiency.

Those skilled in the art will appreciate that in some applications, a big switch called "Starter unit switchgear" is used instead of the VSD; thus, the VSD and Start unit switchgear are interchangeable.

The monitoring system further extends the pattern mapping in the above system described in (a) to include the VSD internal DC power rail voltage and any ripple on this including frequency content. This may be extended to critical internal component temperatures in VSD skids, including VSD drivers and main transformers. VSD skids may be flat metal structures resembling barges and used to mount VSD or Starter unit Switchgears (320), voltage transformers, and any other production controller (138) used for the operations of multi-stage centrifugal pumps (124). Skids may be used to facilitate the transport and installation of such equipment in remote locations. The monitoring system uses harmonic analysis and waveform analysis of the VSD output power to detect failure or degradation of VSD internal high voltage switching components. Functionality of the monitoring system includes monitoring the VSD output power and power quality of the final drive transformer (318) and compare to output power and power quality on the output side of the VSD or Starter unit Switchgear (320) to continuously monitor the final drive transformer (318) condition and add to the ESP system (100) pattern mapping. By measuring how close to ideal the input and output power is, it is possible to monitor the electrical power quality more closely (how ideal or sinusoidal it is) and establish any links between this power and system reliability.

The DCS (150) may include power sources such as power utilities that serve a particular well. Commonly, a step-down transformer is connected to the power utilities and reduces the voltage at the input rating of the VSD or starter unit switchgear (320). The VSD or Starter unit Switchgear (320) can change frequency of the electrical power and the output is connected to the transformer to convert the VSD or starter unit switchgear (320) output into a suitable voltage for the motor (118).

Figure 4:
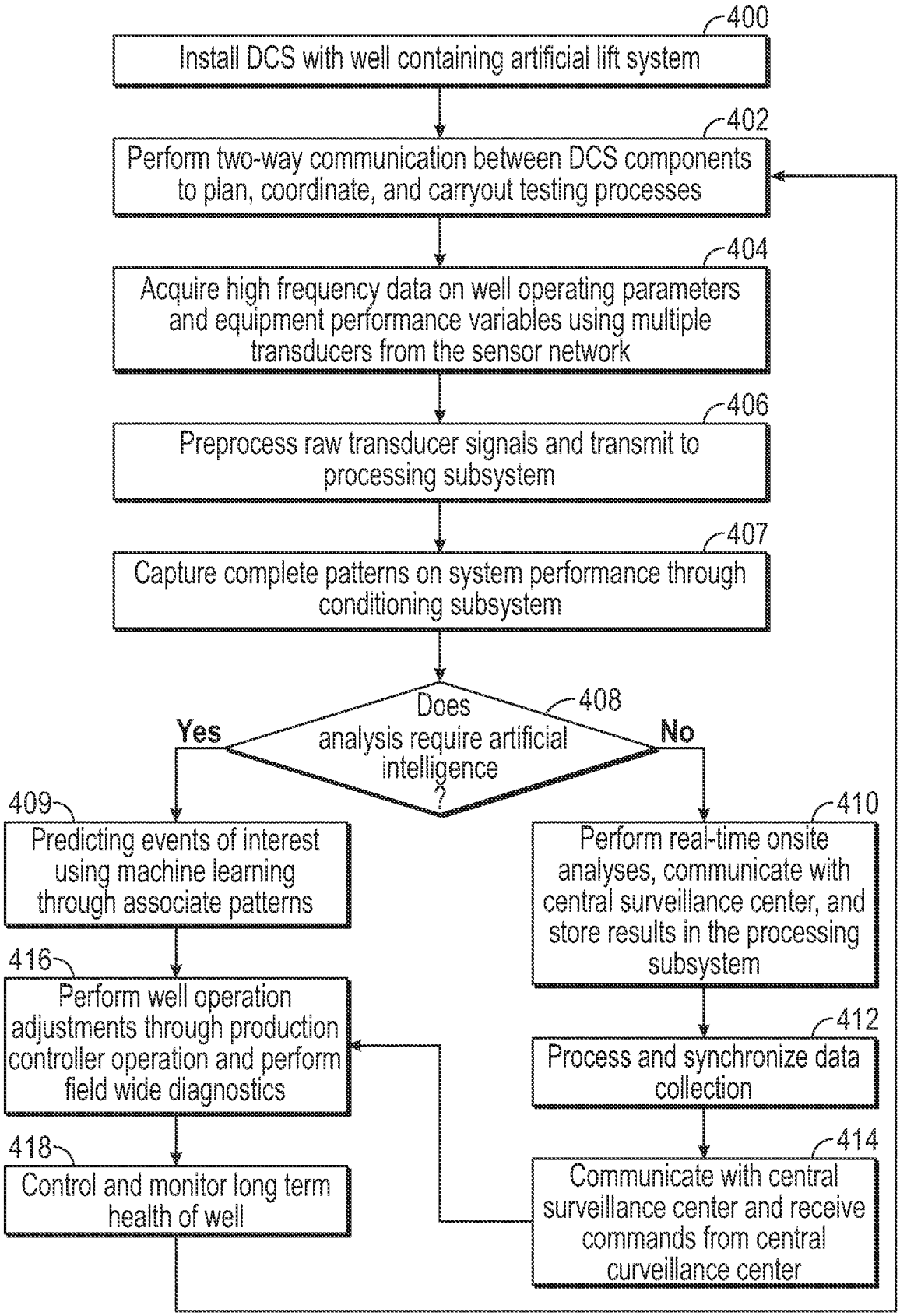
FIG. 4 shows a flowchart in accordance with one or more embodiments.

FIG. 4 shows a flowchart in accordance with one or more embodiments. Specifically, the flowchart illustrates a method for performing field wide diagnostics and control to both perform short term data analysis used to control fluid levels and pressures and long-term analysis used to output health and condition information of a well having an artificial lift system (e.g., 100) using the DCS (150). Further, one or more blocks in FIG. 4 may be performed by one or more components as described in FIGS. 1-3. While the various blocks in FIG. 4 are presented and described sequentially, one of ordinary skill in the art will appreciate that some or all the blocks may be executed in different orders, may be combined or omitted, and some or all of the blocks may be executed in parallel. Furthermore, the blocks may be performed actively or passively.

Initially, a DCS (150) is installed with a well (115) containing an ESP system (100) or another suitable artificial lift system (Block 400). In this disclosure, the DCS (150) is located on surface and one or more of the components described above in FIGS. 2-3. In Block 402, the DCS (150) performs two-way communication between the components to plan, coordinate, and carryout testing processes. The processor in the processing subsystem may be used to carry out testing on the artificial lift system (e.g., 100). Test coordination among the DCS (150) components may involve performing one or more of the following tests on the artificial lift system (e.g., 100).

(1) System impedance test. For this test, the downhole sensor injects a collection of AC/DC signals with agreed magnitudes and frequencies for the surface sensor to detect and measure. The attenuation profile of these signals provides a signature profile of the impedance of the system. Periodic impedance tests allow assessing the condition change of the insulation over time and forecasting impending failures. The system impedance test may be performed with the artificial lift system (e.g., 100) under operation, before startup or after a shutdown. The properties of the injected signals may differ for each case. This can also be used to detect if the three phases respond to the injected signals differently also indicating cable conditions in each phase.

(2) System Efficiency Test. This test may be measured at several stages in the ESP/artificial lift power transfer process. With surface flow and fluid measurement, the delivered fluid power from the well may be measured. If this is combined with downhole pressure and fluid measurement, the fluid power delivered at the location of the pump is also measured. With the correct sensors the slip in the ESP motor (118) can be measured and combined with phase angle measurements to further extract motor efficiency from overall pump efficiency.

(3) Failure location test. Where cable faults develop, there are several ways to determine the location of this fault. By monitoring the phase to ground voltage on each phase individually, the DCS can determine if any fault is more prevalent on one phase because cable faults create a resistive load to ground from the ESP high voltage cable. Fault location can also be extracted using the measured system impedance and then, measuring the difference in voltage to ground, the voltage to ground at the surface is linearly affected by the depth of the low resistance fault.

Those skilled in the art will appreciate that the DCS (150) is not limited to performing the aforementioned tests, and that any suitable testing to assess the health of the artificial life system of a well may be performed. For example, a system insulation test may be performed by sweeping a signal with a known pattern from the downhole sensor. Sweeping a signal may refer to firing a series of signals that may come from the DCS (150) and comparing the signal patterns by a remote receiver that may be a downhole sensor (302). During system insulation testing, a downhole sensing and control array (308) may have AC or DC power supply (310) injected through a 3-phase choke or capacitor coupling. The injection couplings have a finite impedance to DC or to the AC frequency. If a fault develops in the power cable (125), the injection couplings may draw current from the permanent gauge system to ground through the fault. The current may increase the voltage drop across the power injection choke or coupling and reduce the power voltage present on the power cable (125). It is possible to detect insulation faults on the power cable (125) through sensing either an increase in the injected gauge current or a decrease in the gauge power voltage on the power cable (125). Other tests that may be performed using embodiments disclosed herein are system health routine checks and external communications integrity tests.

In Block 404, the DCS (150) acquires high frequency data on well operating parameters and equipment performance variables using multiple transducers from the sensor network (200). The well operating parameters may include but is not limited to motor current, pump intake pressure, fluid temperature, motor temperature, and motor voltage.

In Block 406, the DCS (150) preprocesses raw transducer signals and transmits them to the processing subsystem (204) via the power cable (125) or a dedicated cable. The raw transducer signals may come from the sensor network (200). The processor in the processing subsystem (e.g., 100) may process the sensor data obtained by the sensor network (200). In Block 407, the DCS (150) captures complete patterns on system performance through the conditioning subsystem (206). Complete patterns include spectral content of both voltage and current waveforms and frequency content. Spectral content is known in the art as data measured for specific wavelengths. Spectral content may include frequency data and harmonic content. More specifically, spectral content may be obtained in the frequency domain and be extracted for harmonics and core frequency components.

In one or more embodiments, machine learning (ML) models using ML algorithms may be employed for the continuous monitoring of harmonics and frequency information of the complete patterns (Block 408). When ML is employed, events of interest are predicted using ML through associate patterns (Block 409). Events of interest may include information such as failures, equipment degradation, and more. Different types of ML models may be trained with the sensor data, such as convolutional neural networks, deep neural networks, recurrent neural networks, support vector machines, decision trees, inductive learning models, deductive learning models, supervised learning models, unsupervised learning models, reinforcement learning models, etc. In some embodiments, two or more different types of ML models are integrated into a single ML architecture, e.g., a ML model may include decision trees and neural networks. In some embodiments, the DCS (150) with ML may generate augmented or synthetic data to produce a large amount of interpreted data for real time analysis.

In one or more embodiments, ML may be applied in many areas in the complete data processing cycle. For example, ML may take account of the fluid power being delivered and use a map of the DCS (150) system design to determine if the system is running within the design parameters. If the DCS (150) is not running within the design parameters, ML algorithms may be trained to further investigate the other sensor systems and use embedded system operation maps to determine the likely cause of the non-ideal operation of the DCS (150). The ML system may either automatically adjust the DCS (150) to correct the issue or provide a user with a diagnosis and/or series of investigative data reports.

Further, the sensor network (200) and the processing subsystem (204) are able to monitor cable condition in the artificial lift system (e.g., 100) and fault patterns of the power system and motor (118). ML may be used to compare such fault patterns with historical system fault patterns and develop a forward-looking prediction of likely ultimate failure mechanisms and how long the DCS system may continue to operate. In yet another application, if the sensor network (200) and the processing subsystem (204) identify the stability and extent of the pulse width modulation (PWM) output variation from the VSD power (316), ML may be used to compare the system design limitations and establish the likely effect of the present operational mode on the lifespan of the power unit and the downhole pumping system. Further, the output of the ML model may prompt adjustment of the DCS (150) to improve the projected life span or may be used to prepare a measured report for the operator indicating the ML system recommendation for performing an action on the DCS (150).

As noted above, use of ML and ML models is optional. In one or more embodiments, when ML is not utilized or in conjunction with ML, the continuous monitoring of harmonics and frequency information of the complete patterns are used to perform real-time onsite analyses, communicate with the central surveillance center (212), and store results in the processing subsystem (204) (Block 410). Real-time onsite analyses can include power signature analysis, harmonic distortion, failure diagnostics, and remaining useful life estimation. This data collection is then processed and synchronized (Block 412) and continually stored in the permanent wellsite monitor (208). The stored data may then be used to construct historical trends.

Through communication with the central surveillance center (212) by means of over the air or cabled communications, commands are received (Block 414) to the DCS (150). An example of the communication with the central surveillance center (212) is supervisory control and data acquisition (SCADA). In Block 416, the DCS (150) performs well operation adjustments through the production controller (138) and performs field wide diagnostics. The well operation adjustments may be made through adjusting frequency or modes of operation. In Block 418, the DCS (150) controls and monitors long term health of well through the permanent local wellsite monitor (208). The process continues back to Block 402 and proceed through the flow chart as many times as necessary.

Figure 5:
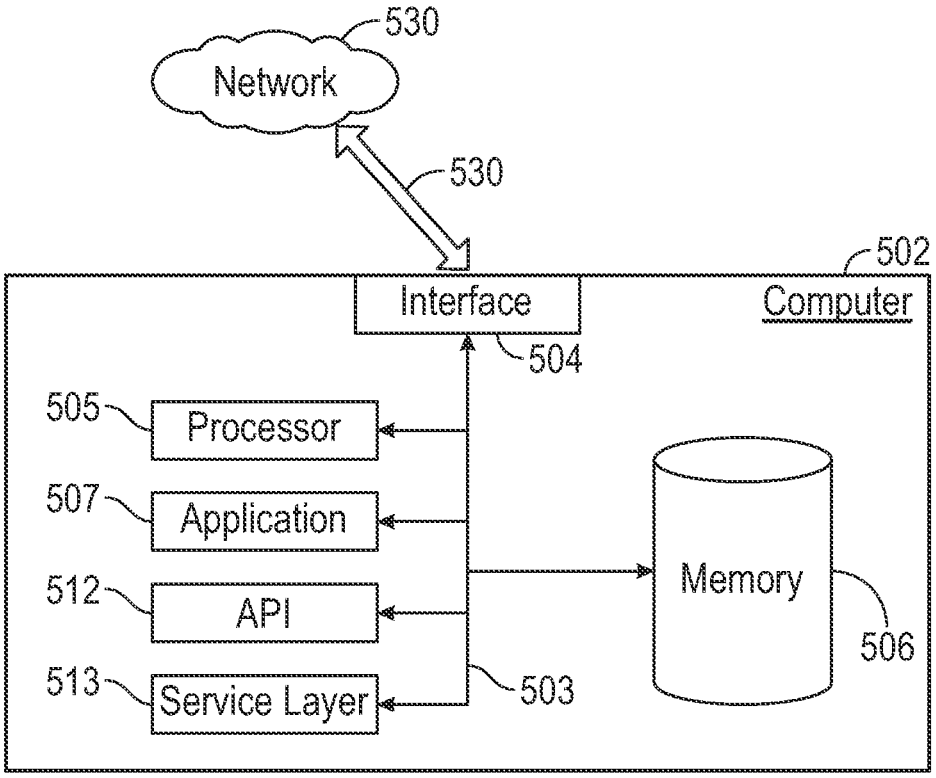
FIG. 5 shows a computer system in accordance with one or more embodiments.

FIG. 5 shows a computer (502) system in accordance with one or more embodiments. Specifically, FIG. 5 shows a block diagram of a computer (502) system used to provide computational functionalities associated with described algorithms, methods, functions, processes, flows, and procedures as described in the instant disclosure, according to an implementation. The illustrated computer (502) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device.

Additionally, the computer (502) may include a computer that includes an input device, such as a keypad, keyboard, touch screen, or other device that can accept user information, and an output device that conveys information associated with the operation of the computer (502), including digital data, visual, or audio information (or a combination of information), or a GUI.

The computer (502) can serve in a role as a client, network component, a server, a database or other persistency, or any other component (or a combination of roles) of a computer system for performing the subject matter described in the instant disclosure. The illustrated computer (502) is communicably coupled with a network (530). In some implementations, one or more components of the computer (502) may be configured to operate within environments, including cloud-computing-based, local, global, or other environment (or a combination of environments).

At a high level, the computer (502) is an electronic computing device operable to receive, transmit, process, store, or manage data and information associated with the described subject matter. According to some implementations, the computer (502) may also include or be communicably coupled with an application server, e-mail server, web server, caching server, streaming data server, business intelligence (BI) server, or other server (or a combination of servers).

The computer (502) can receive requests over network (530) from a client application (for example, executing on another computer (502)) and responding to the received requests by processing the said requests in an appropriate software application. In addition, requests may also be sent to the computer (502) from internal users (for example, from a command console or by other appropriate access method), external or third-parties, other automated applications, as well as any other appropriate entities, individuals, systems, or computers.

Each of the components of the computer (502) can communicate using a system bus (503). In some implementations, any, or all of the components of the computer (502), both hardware or software (or a combination of hardware and software), may interface with each other or the interface (504) (or a combination of both) over the system bus (503) using an application programming interface (API) (512) or a service layer (513) (or a combination of the API (512) and service layer (513). The API (512) may include specifications for routines, data structures, and object classes. The API (512) may be either computer-language independent or dependent and refer to a complete interface, a single function, or even a set of APIs. The service layer (513) provides software services to the computer (502) or other components (whether or not illustrated) that are communicably coupled to the computer (502).

The functionality of the computer (502) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or other suitable format. While illustrated as an integrated component of the computer (502), alternative implementations may illustrate the API (512) or the service layer (513) as stand-alone components in relation to other components of the computer (502) or other components (whether or not illustrated) that are communicably coupled to the computer (502). Moreover, any or all parts of the API (512) or the service layer (513) may be implemented as child or sub-modules of another software module, enterprise application, or hardware module without departing from the scope of this disclosure.

The computer (502) includes an interface (504). Although illustrated as a single interface (504) in FIG. 5, two or more interfaces (504) may be used according to particular needs, desires, or particular implementations of the computer (502). The interface (504) is used by the computer (502) for communicating with other systems in a distributed environment that are connected to the network (530). Generally, the interface (504) includes logic encoded in software or hardware (or a combination of software and hardware) and operable to communicate with the network (530). More specifically, the interface (504) may include software supporting one or more communication protocols associated with communications such that the network (530) or interface's hardware is operable to communicate physical signals within and outside of the illustrated computer (502).

The computer (502) includes at least one computer processor (505). Although illustrated as a single computer processor (505) in FIG. 5, two or more processors may be used according to particular needs, desires, or particular implementations of the computer (502). Generally, the computer processor (505) executes instructions and manipulates data to perform the operations of the computer (502) and any algorithms, methods, functions, processes, flows, and procedures as described in the instant disclosure.

The computer (502) also includes a non-transitory computer (502) readable medium, or a memory (506), that holds data for the computer (502) or other components (or a combination of both) that can be connected to the network (530). For example, memory (506) can be a database storing data consistent with this disclosure. Although illustrated as a single memory (506) in FIG. 5, two or more memories may be used according to particular needs, desires, or particular implementations of the computer (502) and the described functionality. While memory (506) is illustrated as an integral component of the computer (502), in alternative implementations, memory (506) can be external to the computer (502).

The application (507) is an algorithmic software engine providing functionality according to particular needs, desires, or particular implementations of the computer (502), particularly with respect to functionality described in this disclosure. For example, application (507) can serve as one or more components, modules, applications, etc. Further, although illustrated as a single application (507), the application (507) may be implemented as multiple applications (507) on the computer (502). In addition, although illustrated as integral to the computer (502), in alternative implementations, the application (507) can be external to the computer (502).

There may be any number of computers (502) associated with, or external to, a computer system containing computer (502), each computer (502) communicating over network (530). Further, the term "client," "user," and other appropriate terminology may be used interchangeably as appropriate without departing from the scope of this disclosure. Moreover, this disclosure contemplates that many users may use one computer (502), or that one user may use multiple computers (502).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A diagnostics and control system (DCS) for an artificial lift system (ALS) in a well, the DCS comprising:

a sensor network comprising a plurality of sensors for monitoring and obtaining measurements at a power source of the ALS and at a downhole pump of the ALS;

a conditioning subsystem configured to measure ALS system performance data, the ALS system performance data comprising capturing a plurality of complete patterns comprising spectral content of voltage and current waveforms, harmonics, and frequency;

a processing subsystem configured to receive communications from the conditioning subsystem and comprising a processor configured to process sensor data obtained by the sensor network; and a permanent local wellsite monitor that is controlled by the processing subsystem and is powered using a production controller of the ALS, wherein the permanent local wellsite monitor comprises a central surveillance center for transmitting commands and coordinating testing of the ALS among the sensor network, the conditioning subsystem, and the processing subsystem, wherein a condition of the ALS is evaluated by the permanent local wellsite monitor using the processed sensor data, testing results and system performance data to monitor a health of the ALS, and wherein evaluating the condition of the ALS comprises:

sending high speed pulses on only a first power cable conductor of a 3-phase power system of the ALS:

recording, in response to sending the high speed pulses, response on a second power cable conductor of the 3-phase power system, the second conductor being separate from the first conductor;

determining, based at least on the recorded response on the second conductor, a power cable condition of the 3-phase power system;

establishing microsecond windows in each waveform cycle of the 3-phase power system; and comparing the recorded response recovered from each of the microsecond windows to extract common data to remove noise effects, wherein said determining the power cable condition is based on the extracted common data.

2. The DCS of claim 1, wherein the sensor network comprises: a surface sensor subsystem connected to a power cable of the ALS and a downhole sensor subsystem installed downhole in the well and connected to a pump of the ALS, wherein the sensor subsystems comprise a plurality of transducers for acquiring high frequency data on well operating parameters and equipment performance variables, and wherein the sensor subsystems are configured to harvest energy from the ALS and provide power to the DCS.

3. The DCS of claim 1, wherein the processing subsystem is further configured to:

receive and process commands from the central surveillance center; and autonomously operate a production controller to perform well operation adjustments, wherein the production controller comprises a variable speed drive, a well choke, and inflow control valves.

4. The DCS of claim 1, wherein the testing of the ALS comprises at least one of:

a system impedance test, a system efficiency test, and a failure location test of the ALS.

5. The DCS of claim 1, wherein the conditioning subsystem is further configured to capturing additional raw data on system performance comprising electrical signals and data from transducers installed in or near the well and forward the additional raw data to the processing subsystem.

6. The DCS of claim 1, wherein the DCS is configured to coordinate and perform customized testing routines for the ALS comprising insulation testing checks, system health routine checks, and external communications integrity tests.

7. The DCS of claim 1, wherein the sensor network, the processing subsystem and the conditioning subsystem communicate via two-way communication and are operatively connected wirelessly.

8. The DCS of claim 1, wherein the central surveillance center is connected directly to an end user and is configured to generate alarms associated with the health of the ALS and recommend optimization processes for the ALS.

9. The DCS of claim 1, wherein the processing subsystem comprises a machine learning model used for continuous monitoring of harmonics and frequency information to obtain complete patterns of ALS components.

10. A method for monitoring a health of an artificial lift system (ALS) comprising:

installing a diagnostic and control system (DCS) in a well operated with the ALS, the DCS comprising a sensor network for obtaining sensor measurements at least a downhole pump of the ALS, a processing subsystem for processing sensor data from the sensor measurements, and a conditioning subsystem configured to measure ALS system performance data;

coordinating and performing periodic automated testing of the ALS by the DCS;

capturing spectral content of current and voltage waveforms, harmonics, and frequency of components of the ALS; and evaluating a condition of the ALS using the sensor measurements and system performance data to monitor a health of the ALS, wherein the current and voltage waveforms, harmonic content, and frequency content of components of the ALS are used to obtain a complete pattern of ALS system performance, wherein evaluating the condition of the ALS comprises:

sending high speed pulses on only a first power cable conductor of a 3-phase power system of the ALS;

recording, in response to sending the high speed pulses, response on a second power cable conductor of the 3-phase power system, the second conductor being separate from the first conductor;

determining, based at least on the recorded response on the second conductor, a power cable condition of the 3-phase power system;

establishing microsecond windows in each waveform cycle of the 3-phase power system; and comparing the recorded response recovered from each of the microsecond windows to extract common data to remove noise effects, wherein said determining the power cable condition is based on the extracted common data.

11. The method of claim 10, further comprising:

acquiring high frequency data on well operating parameters using the sensor network; and storing results of the periodic automated tests to construct historical trends.

12. The method of claim 11, further comprising:

using machine learning models trained using the historical trends to continuously monitor harmonics and frequency information to obtain the complete pattern of ALS system performance.

13. The method of claim 10, wherein the condition of the ALS evaluated by the DCS is used to control fluid levels and pressures of the ALS and to optimize longevity of the ALS by continuous, permanent monitoring.

14. The method of claim 10, further comprising harvesting energy from the ALS to power the DCS.

15. The method of claim 10, wherein performing periodic automated testing of the ALS comprises performing at least one of: a system impedance test, a system efficiency test, a failure location test of the ALS, insulation testing checks, system health routine checks, and external communications integrity tests.

16. The method of claim 10, further comprising: generating alarms associated with the health of the ALS and transmitting the alarms directly to an end user.

17. The method of claim 10, further comprising:

receiving and processing commands from a central surveillance center comprising DCS configurations; and capturing additional raw data on system performance, the additional raw data comprising electrical signals and data from transducers installed in or near the well.

* * * * *